US008368602B2

(12) United States Patent
Hill et al.

(10) Patent No.: US 8,368,602 B2
(45) Date of Patent: Feb. 5, 2013

(54) PARALLEL-FED EQUAL CURRENT DENSITY DIPOLE ANTENNA

(75) Inventors: Robert J. Hill, Salinas, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 315 days.

(21) Appl. No.: 12/793,641

(22) Filed: Jun. 3, 2010

(65) Prior Publication Data

US 2011/0300907 A1 Dec. 8, 2011

(51) Int. Cl.
*H01Q 1/24* (2006.01)
*H01Q 13/10* (2006.01)

(52) U.S. Cl. ..... 343/702; 343/767

(58) Field of Classification Search ..... 343/702, 343/767, 768, 700 MS, 846
See application file for complete search history.

(56) References Cited

U.S. PATENT DOCUMENTS

| | | | |
|---|---|---|---|
| 4,130,822 | A | 12/1978 | Conroy |
| 4,590,614 | A | 5/1986 | Erat |
| 4,682,180 | A | 7/1987 | Gans |
| 4,853,704 | A | 8/1989 | Diaz et al. |
| 4,873,529 | A | 10/1989 | Gibson |
| 4,876,552 | A | 10/1989 | Zakman |
| 4,903,326 | A | 2/1990 | Zakman et al. |
| 5,274,391 | A | 12/1993 | Connolly |
| 5,568,159 | A | 10/1996 | Pelton et al. |
| 5,581,266 | A | 12/1996 | Peng et al. |
| 5,966,101 | A | 10/1999 | Haub et al. |
| 6,054,952 | A | 4/2000 | Shen et al. |
| 6,057,804 | A | 5/2000 | Kaegebein |
| 6,266,538 | B1 | 7/2001 | Waldron |
| 6,281,850 | B1 | 8/2001 | Klostermann |
| 6,292,153 | B1 | 9/2001 | Aiello et al. |
| 6,452,552 | B1 | 9/2002 | Ishitobi et al. |
| 6,466,176 | B1 | 10/2002 | Maoz et al. |

(Continued)

FOREIGN PATENT DOCUMENTS

| | | |
|---|---|---|
| EP | 1 351 334 | 10/2003 |
| EP | 1 401 050 | 3/2004 |

(Continued)

OTHER PUBLICATIONS

G. Lee et al. "Size reduction of microstrip-fed slot antenna by inductive and capacitive loading", Jun. 2003 IEEE Antennas and Propagation Society International Symposium, pp. 312-315.

*Primary Examiner* — Hoang V Nguyen
(74) *Attorney, Agent, or Firm* — Treyz Law Group; G. Victor Treyz; Chih-Yun Wu

(57) ABSTRACT

Electronic devices such as handheld devices may have wireless communications circuitry. The wireless communications circuitry may include a broadband antenna and circuitry that covers multiple communications bands. The broadband antenna may be formed from a parallel-fed dipole. The antenna may have first and second antenna resonating element regions on opposing sides of a slot. The slot may be an open slot that has one open end and one closed end. The slot may be formed from an opening in conductive housing structures in a conductive housing for an electronic device. The conductive housing structures may include sidewall structures, rear housing wall structures, and other conductive structures. The antenna may have a feed with a feed line that crosses the slot. An interposed dielectric substrate member may separate the feed line from the conductive structures. The feed line may have sections with different widths to minimize feed line length.

19 Claims, 20 Drawing Sheets

U.S. PATENT DOCUMENTS 6,486,836 B1 11/2002 Hill et al.
6,492,947 B2 12/2002 Anderson
6,603,430 B1 8/2003 Hill et al.
6,720,934 B1 4/2004 Price et al.
6,788,266 B2 9/2004 St. Hillaire et al.
6,853,336 B2 * 2/2005 Asano et al. ..... 343/702
6,903,692 B2 6/2005 Kivekas et al.
6,906,675 B2 6/2005 Satoh et al.
6,963,310 B2 11/2005 Horita et al.
6,982,675 B2 1/2006 Kwak et al.
7,002,519 B2 2/2006 Wang et al.
7,023,388 B2 4/2006 Shimabara
7,042,400 B2 5/2006 Okubo et al.
7,075,493 B2 7/2006 Azadegan et al.
7,227,506 B1 6/2007 Lewis, Jr.
7,352,326 B2 4/2008 Korva et al.
7,362,275 B2 4/2008 Tu et al.
7,432,870 B2 10/2008 Teshima et al.
7,432,873 B2 10/2008 Brachat et al.
7,619,578 B2 11/2009 Kanno
7,701,407 B2 * 4/2010 Kanno et al. ..... 343/767
8,077,096 B2 * 12/2011 Chiang et al. ..... 343/702
2002/0019247 A1 2/2002 Egorov
2003/0063036 A1 4/2003 Sato et al.
2004/0008146 A1 1/2004 Ikegaya et al.
2004/0017318 A1 1/2004 Annabi et al.
2004/0108957 A1 6/2004 Umehara et al.
2004/0164916 A1 8/2004 Jecko et al.
2004/0212545 A1 10/2004 Li et al.
2004/0257283 A1 12/2004 Asano et al.
2005/0078037 A1 4/2005 Leclerc et al.
2005/0093750 A1 5/2005 Vance
2005/0110686 A1 5/2005 Frederik du Toit
2005/0128151 A1 6/2005 Kwak et al.
2005/0128161 A1 6/2005 Kagaya et al.
2006/0017643 A1 1/2006 Shimasaki et al.
2006/0038721 A1 2/2006 Ozkar et al.
2006/0208950 A1 9/2006 Tago
2006/0214856 A1 9/2006 Nakano et al.
2006/0238425 A1 10/2006 Oodachi
2007/0182658 A1 8/2007 Ozden
2007/0241971 A1 10/2007 Tsujimura et al.
2008/0106478 A1 5/2008 Hill
2008/0165064 A1 7/2008 Hill et al.
2008/0231521 A1 9/2008 Anguera Pros et al.
2009/0153410 A1 * 6/2009 Chiang et al. ..... 343/702
2009/0315785 A1 * 12/2009 Yang ..... 343/702
2010/0085262 A1 * 4/2010 Wolf ..... 343/768
2011/0254741 A1 * 10/2011 Ishimiya ..... 343/702

FOREIGN PATENT DOCUMENTS

WO 2004/001894 12/2003
WO 2005/109567 11/2005
WO 2006/070017 7/2006

* cited by examiner

PARALLEL-FED EQUAL CURRENT DENSITY DIPOLE ANTENNA

BACKGROUND

This relates generally to antennas, and more particularly, to electronic device antennas and electronic device antenna feed arrangements.

Electronic devices such as handheld electronic devices are becoming increasingly popular. Examples of handheld devices include handheld computers, cellular telephones, media players, and hybrid devices that include the functionality of multiple devices of this type.

Devices such as these are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also handle the 2100 MHz band. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz. It is sometimes desirable to receive satellite navigation system signals such as signals from the Global Positioning System (GPS). Electronic devices may therefore be provided with circuitry for receiving satellite navigation signals such as GPS signals at 1575 MHz.

To satisfy consumer demand for small form factor wireless devices, manufacturers are continually striving to implement wireless communications circuitry such as antenna structures using compact structures. At the same time, it may be desirable to form an electronic device from conductive structures such as conductive housing structures. Because conductive materials can affect radio-frequency performance, challenges arise when incorporating antennas into electronic devices with conductive structures. Efficient antenna feed arrangements are also challenging to implement. If care is not taken, antenna performance can be degraded in an electronic device with a conductive structure such as a conductive housing.

It would therefore be desirable to be able to provide improved antenna structures for electronic devices.

SUMMARY

An electronic device may be provided that has wireless communications circuitry. The wireless communications circuitry may include one or more antennas. The antennas may be formed from conductive structures such as conductive housing structures. Feed structures may be provided for the antennas.

The electronic device may be a portable electronic device with a rectangular housing. A display may be provided on the front surface of the housing. Conductive housing sidewalls may surround the housing and a planar conductive rear housing wall may be used in forming the rear of the housing.

The conductive structures from which the antennas may be formed may include portions of the conductive housing walls. For example, an antenna may be formed from a slot in a housing sidewall that runs parallel to one of the edges of the rectangular housing and one of the edges of the display.

The antennas may be broadband antennas formed from using a parallel-fed dipole configuration. An antenna of this type may have first and second antenna resonating element regions on opposing sides of a slot. The slot may be an open slot that has one open end and one closed end. The slot may be formed from an opening in conductive structures such as conductive housing walls.

The antenna may have a feed with a feed line that crosses the slot. An interposed dielectric substrate member may separate the feed line from the conductive structures. The feed line may have sections with different widths to minimize feed line length.

Further features of the invention, its nature and various advantages will be more apparent from the accompanying drawings and the following detailed description of the preferred embodiments.

DETAILED DESCRIPTION

Electronic devices may be provided with wireless communications circuitry. The wireless communications circuitry may be used to support wireless communications in multiple wireless communications bands. The wireless communications circuitry may include one or more antennas.

Antenna structures may be provided in electronic devices such as desktop computers, game consoles, routers, laptop computers, tablet computers, etc. With one suitable configuration, antenna structures may be provided in relatively compact electronic devices such as portable electronic devices.

Figure 1:
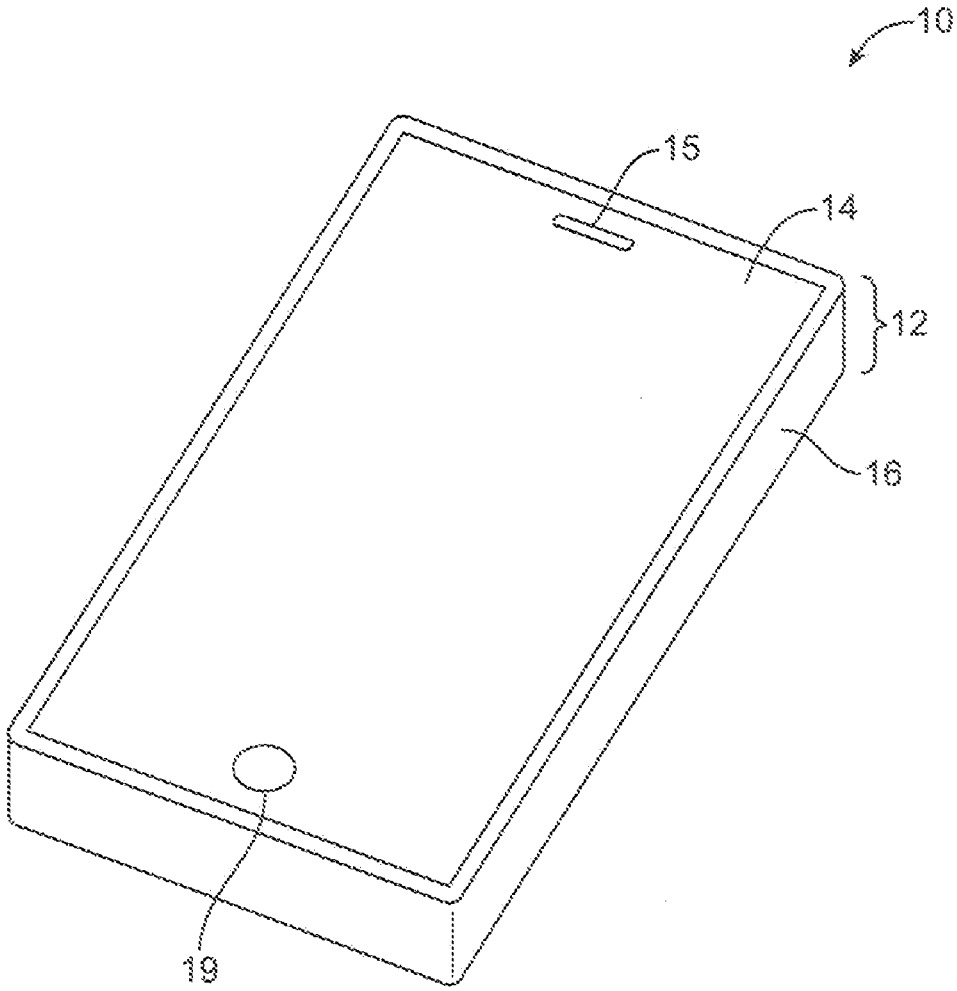
FIG. 1 is a perspective view of an illustrative electronic device with wireless communications circuitry in accordance with an embodiment of the present invention.

An illustrative portable electronic device that may include antennas is shown in FIG. 1. Portable electronic devices such as illustrative portable electronic device 10 of FIG. 1 may be laptop computers or small portable computers such as ultraportable computers, netbook computers, and tablet computers. Portable electronic devices such as device 10 may also be somewhat smaller devices. Examples of smaller portable electronic devices include wrist-watch devices, pendant devices, headphone and earpiece devices, and other wearable and miniature devices. With one suitable arrangement, portable electronic device 10 may be a handheld electronic device such as a cellular telephone or music player.

Device 10 includes housing 12 and includes at least one antenna for handling wireless communications. Housing 12, which is sometimes referred to as a case, may be formed of any suitable materials including, plastic, glass, ceramics, composites, metal, other suitable materials, or a combination of these materials. In some situations, parts of housing 12 may be formed from dielectric or other low-conductivity material, so that the operation of conductive antenna elements that are located within housing 12 is not disrupted. In other situations, housing 12 may be formed from conductive elements. Housing 12 may be formed using a unibody construction technique in which most or all of housing 12 is formed from a single piece of material. Housing 12 may, for example, be formed from a piece of machined or cast aluminum or stainless steel. Housing 12 may also be formed from multiple smaller housing structures (i.e., frame structures, sidewalls, peripheral bands, bezels, etc.). Unibody housing structures and housing structures formed from multiple pieces may be formed from metal, plastic, composites, or other suitable materials.

Device 10 may have a display such as display 14. Display 14 may be a touch screen that incorporates capacitive touch electrodes or other touch sensitive elements. Display 14 may include image pixels formed form light-emitting diodes (LEDs), organic LEDs (OLEDs), plasma cells, electronic ink elements, liquid crystal display (LCD) components, or other suitable image pixel structures. A cover glass member may cover the surface of display 14. Buttons such as button 19 and speaker ports such as speaker port 15 may be formed in openings in the cover glass. Buttons and ports may also be formed in housing 12.

Housing 12 may include housing sidewall structures such as sidewall structures 16. Some or all of structures 16 may be formed using conductive materials. For example, structures 16 may be implemented using a conductive ring-shaped band member that substantially surrounds the rectangular periphery of display 14. Structures 16 may form straight or curved sidewalls for housing 12. If desired, structures 16 may be formed from a unitary body structure that includes housing sidewalls and an associated rear planar portion (i.e., a planar portion that forms the rear of device 10. Structures 16 and other structures in housing 12 may be formed from a metal such as stainless steel, aluminum, or other suitable materials. Structures 16 or a separate member may serve as a bezel that holds display 14 to the front (top) face of device 10 and/or that serves as a cosmetic trim piece for display 14.

Antennas in device 10 may be used to support any communications bands of interest. For example, device 10 may include antenna structures for supporting local area network communications, voice and data cellular telephone communications, global positioning system (GPS) communications, Bluetooth® communications, etc. If desired, a broadband antenna may be used that covers multiple communications bands.

Figure 2:
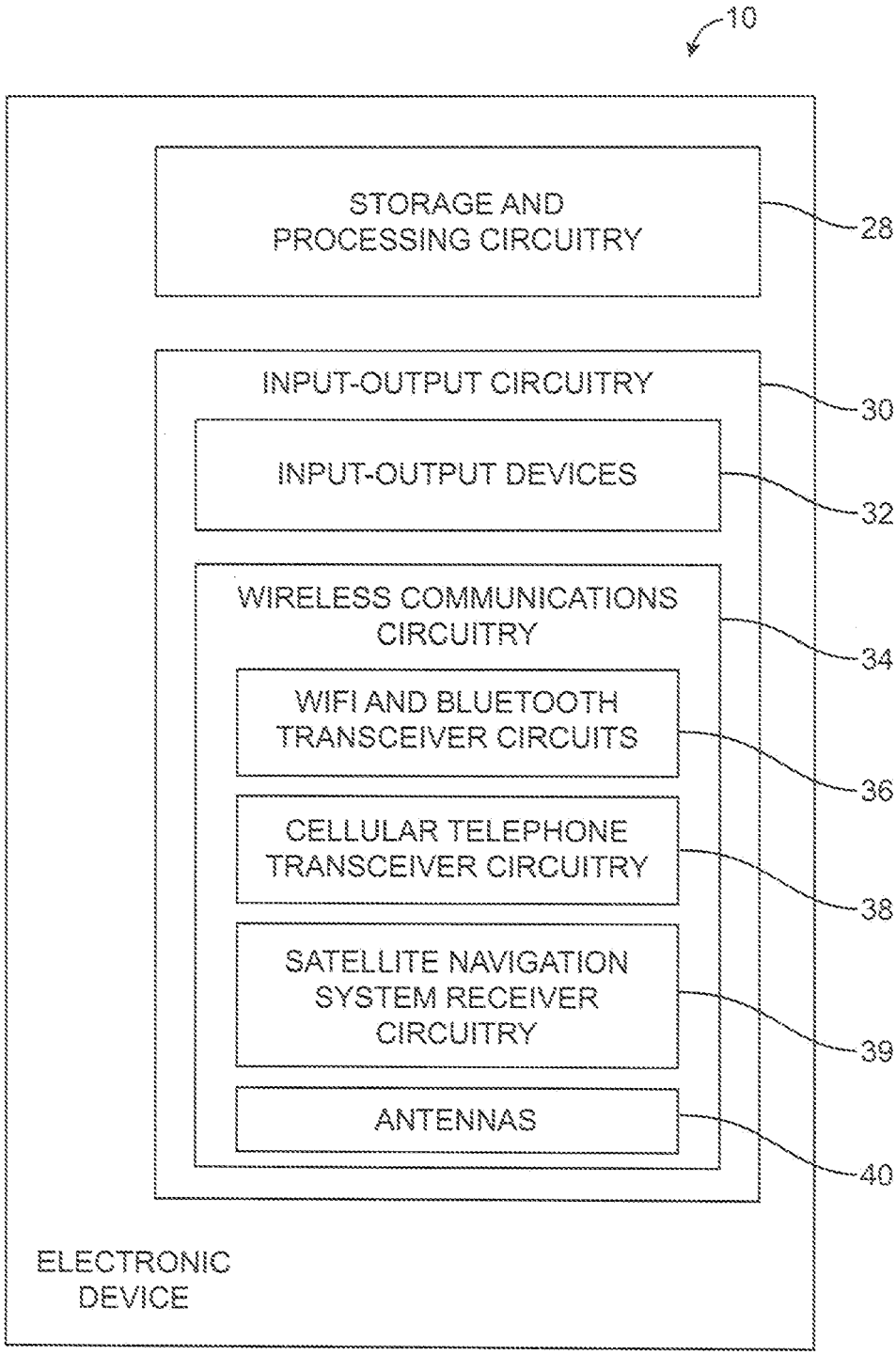
FIG. 2 is a schematic diagram of an illustrative electronic device with wireless communications circuitry in accordance with an embodiment of the present invention.

A schematic diagram of illustrative electronic components that may be used within device 10 of FIG. 1 is shown in FIG. 2. As shown in FIG. 2, device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, applications specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output devices 32 such as touch screens and other user input interface are examples of input-output circuitry 32. Input-output devices 32 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices such as display 14 (FIG. 1) and other components that present visual information and status data may be included in devices 32. Display and audio components in input-output devices 32 may also include audio equipment such as speakers and other devices for creating sound. If desired, input-output devices 32 may contain audio-video interface equipment such as jacks and other connectors for external headphones and monitors.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 34 may include radio-frequency transceiver circuits for handling multiple radio-frequency communications bands. For example, circuitry 34 may include transceiver circuitry 36 and 38 and satellite navigation system receiver 39.

Satellite navigation system receiver circuitry 39 may be used to receive satellite positioning system signals such as GPS signals at 1575 MHz from satellites associated with the Global Positioning System. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as the bands at 850 MHz, 900 MHz, 1800 MHz, 1900 MHz, and 2100 MHz data band (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. With one suitable arrangement, which is sometimes described herein as an example, at least one antenna 40 in device 10 may be formed using a dipole structure.

Figure 3:
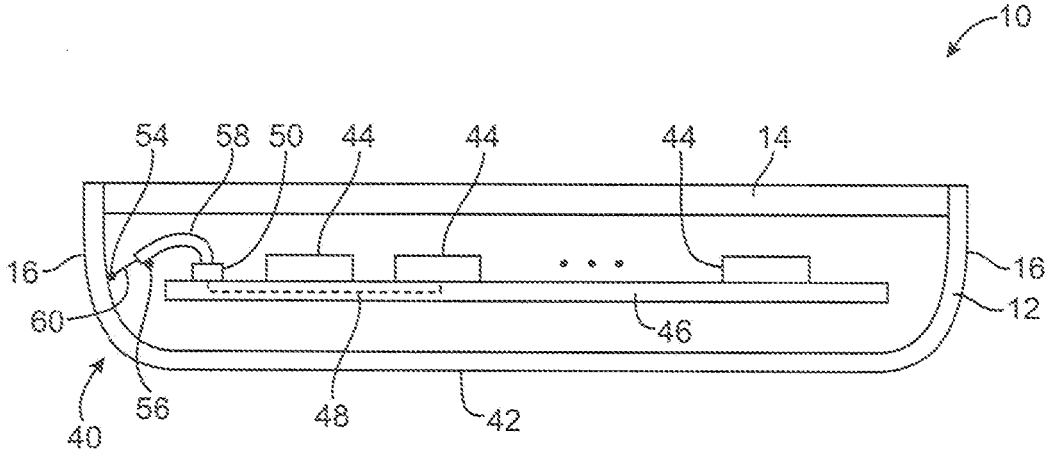
FIG. 3 is a cross-sectional side view of an illustrative electronic device with wireless communications circuitry in accordance with an embodiment of the present invention.

A cross-sectional side view of device 10 of FIG. 1 taken is shown in FIG. 3. Display 14 may be mounted to the front surface of device 10. Rear wall 42 and sidewalls 16 of housing 12 may be formed from separate housing structures or may be formed as integral portions of the same structure as shown in FIG. 3.

In the illustrative arrangement shown in FIG. 3, antenna 40 for device 10 has been formed from part of housing 12 (e.g., in an arrangement in which housing 12 is formed from a conductive material such as metal). Antenna 40 may, for example, be formed from part of housing 12 at the lower end of device 10 when viewed in the orientation shown in FIG. 1. Antenna 40 may also be formed on a sidewall of housing 12, along a top edge of housing 12, on a rear wall portion of housing 12, or elsewhere in device 10. Antenna 40 may be fed using an antenna feed having terminals such as positive antenna feed terminal 54 and ground (negative) antenna feed terminal 56.

Antenna signals may be conveyed to and from antenna 40 using transmission line 58. Transmission line 58 may be, for example, a coaxial cable or a microstrip transmission line having an impedance of 50 ohms (as an example). A matching network formed from components such as inductors, resistors, and capacitors may be used in matching the impedance of antenna 40 to the impedance of transmission line 58. Matching network components may be provided as discrete components (e.g., surface mount technology components) or may be formed from housing structures, printed circuit board structures, traces on plastic supports, etc.

Device 10 may contain printed circuit boards such as printed circuit board 46. Printed circuit board 46 and the other printed circuit boards in device 10 may be formed from rigid printed circuit board material (e.g., fiberglass-filled epoxy) or flexible sheets of material such as polymers. Flexible printed circuit boards ("flex circuits") may, for example, be formed from flexible sheets of polyimide.

Printed circuit board 46 may contain interconnects such as interconnects 48. Interconnects 48 may be formed from conductive traces (e.g., traces of gold-plated copper or other metals). Connectors such as connector 50 may be connected to interconnects 48 using solder or conductive adhesive (as examples). Integrated circuits, discrete components such as resistors, capacitors, and inductors, and other electronic components may be mounted to printed circuit board 46. These components are shown as components 44 in FIG. 3.

Components 44 may include one or more integrated circuits that implement transceiver circuits 36 and 38 and receiver circuit 39 of FIG. 2. Connector 50 may be, for example, a coaxial cable connector that is connected between printed circuit board 46 and coaxial cable 58. Terminal 54 may be connected to coaxial cable center connector 60. Terminal 56 may be connected to a ground conductor in cable 58 (e.g., a conductive outer braid conductor). If desired, transmission line 58 may be coupled to feed terminals 54 and 56 using a connector in the vicinity of terminals 54 and 56. Feed conductors (e.g., transmission line conductors, conductive strips on printed circuit boards, vias, feed lines formed from other conductive structures, etc.) may be used in coupling transmission line 58 to antenna 40.

Figure 4:
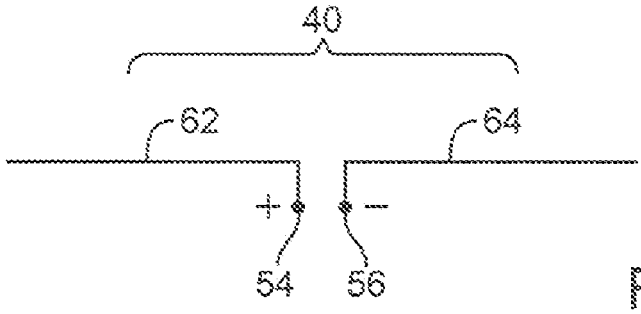
FIG. 4 is a diagram of a dipole antenna architecture that may be used for an antenna in an electronic device in accordance with an embodiment of the present invention.

Antenna 40 may use a dipole configuration of the type shown in FIG. 4. As shown in FIG. 4, positive antenna feed terminal 54 may be connected to first conductor 62 and ground antenna feed terminal 56 may be connected to second conductor 64. Conductors 62 and 64 serve as antenna resonating elements (antenna radiating elements) and may be formed from wires, strips of metal, or other conductive elements.

Figure 5:
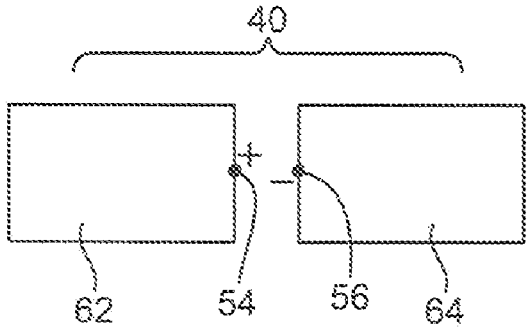
FIG. 5 is a diagram of a broadband dipole antenna architecture that may be used for an antenna in an electronic device in accordance with an embodiment of the present invention.

FIG. 5 shows how antenna resonating elements 62 and 64 may be formed from conductive structures with larger surface areas than the wires of FIG. 4. Conductive structures 62 and 64 of FIG. 5 may be formed from metal traces on printed circuit boards, metal housing structures, or other conductive structures. Use of antenna resonating elements 62 and 64 that are formed from structures with substantial areas may help antenna 40 to exhibit a larger bandwidth than a dipole antenna based on antenna resonating elements formed from wires or narrow metal strips. This may allow antenna 40 to serve as a broadband antenna that covers multiple communications bands of interest.

Figure 6:
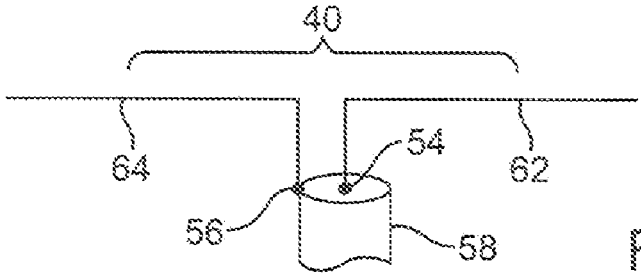
FIG. 6 is a diagram of a series fed dipole antenna arrangement that may be used for an antenna in an electronic device in accordance with an embodiment of the present invention.
Figure 7:
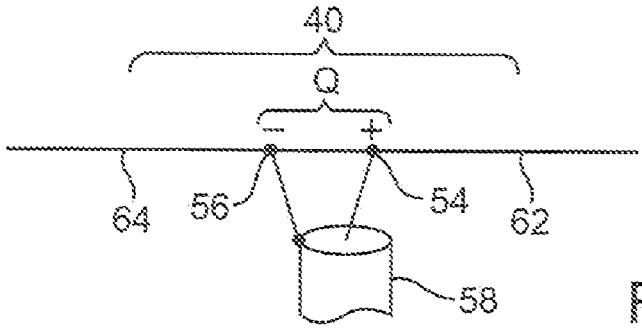
FIG. 7 is a diagram of a parallel-fed dipole antenna architecture that may be used for an antenna in an electronic device in accordance with an embodiment of the present invention.

Antenna 40 may be fed using a series feed or a parallel feed arrangement. FIG. 6 shows how antenna 40 may be series fed from transmission line 58. In FIG. 7, antenna 40 is being fed by transmission line 58 using a parallel feed arrangement. When parallel fed, antenna 40 has a section of antenna resonating element conductor (i.e., section Q) that joins antenna resonating elements 62 and 64.

Figure 8:
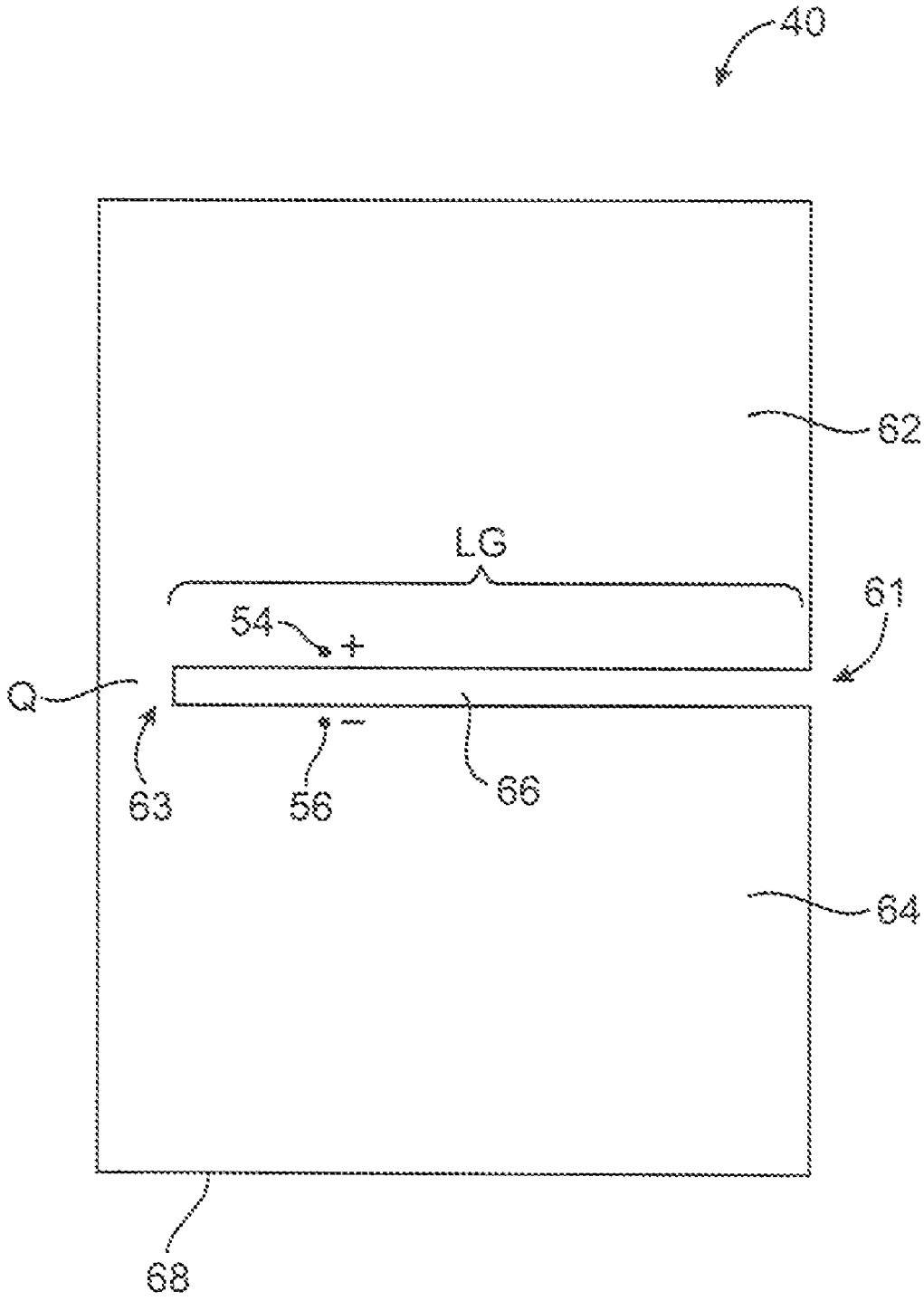
FIG. 8 is a diagram of a broadband parallel-fed dipole antenna architecture that may be used for an antenna in an electronic device in accordance with an embodiment of the present invention.

As shown in FIG. 8, antenna 40 may be formed from conductive regions such as rectangular conductive regions or other two-dimensional resonating elements 62 and 64 to form a broadband antenna. Resonating elements 62 and 64 may be separated by a slot such as slot 66. Slot 66 may be filled with a dielectric such as air, plastic, or other dielectric materials. The conductive structures on opposing sides of antenna slot 66 at end 61 are not electrically connected to each other in the vicinity of end 61 (i.e., end 61 of slot 66 is open), whereas the conductive structures on opposing sides of antenna slot 66 at end 63 are connected through portion Q of conductive structures 68 (i.e., end 63 of slot 66 is closed). Slots such as slot 66 in which one end is open are sometimes referred to as open slots. Slots in which both ends are closed are sometimes referred to as closed slots.

Antenna 40 of FIG. 8 may be fed at antenna feed terminals 54 and 56. Resonating elements 62 and 64 (and therefore terminals 54 and 56) may be electrically shorted to each other at the end of slot 66 using conductive portion Q (i.e., antenna 40 of FIG. 8 uses a parallel-fed arrangement as described in connection with FIG. 7). Because resonating elements 62 and 64 are electrically shorted to each other through portion Q, elements 62 and 64 may be maintained at the same direct-current (DC) voltage level. For example, resonating elements 62 and 64 may be maintained at a common DC ground voltage (at DC frequencies).

Antenna 40 of FIG. 8 may be formed from conductive structure 68. Conductive structure 68 may be formed from an electronic device housing (e.g., housing 12 of device 10) or other conductive structures. When using a parallel-fed arrangement for antenna 40 such as the arrangement of FIG. 8, slot 66 does not completely bisect conductive structure 68. This may help housing 12 maintain structural integrity in configurations in which structure 68 is formed from housing 12.

Figure 9:
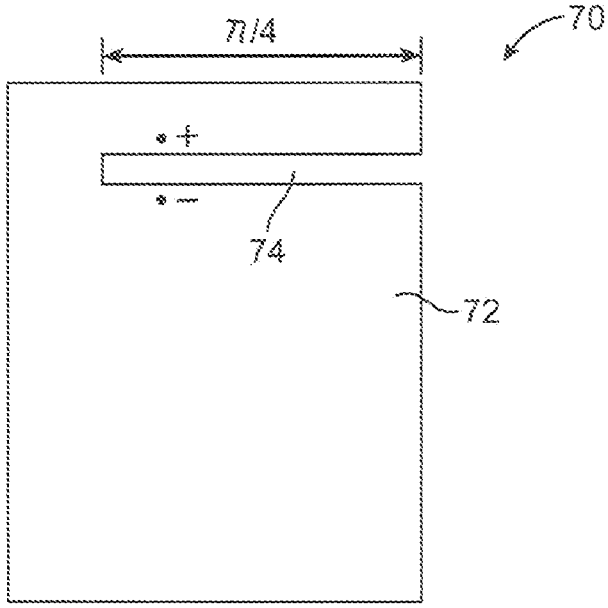
(PRIOR ART) FIG. 9
FIG. 9 is a diagram of a conventional quarter wavelength slot antenna.
Figure 10:
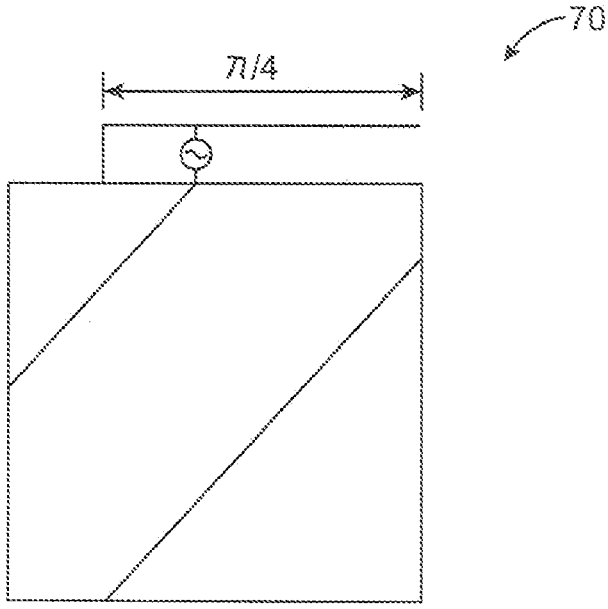
(PRIOR ART) FIG. 10
FIG. 10 is an equivalent circuit diagram of the conventional quarter wavelength slot antenna of FIG. 9.

Slot 66 of antenna 40 of FIG. 8 may have a length LG that is less than the length of a conventional quarter wavelength open slot antenna. A conventional quarter-wavelength open slot antenna is shown in FIG. 9. As shown in FIG. 9, antenna 70 may have a conductive structure 72 having open slot 74. Slot 74 has a length equal to a quarter of a wavelength at signal frequencies of interest. An equivalent circuit for slot antenna 70 of FIG. 9 is shown in FIG. 10. As shown in FIG. 10, antenna 70 of FIG. 9 is electrically equivalent to an inverted-F antenna. In contrast to quarter-wavelength antenna 70 of FIGS. 9 and 10, the length LG of slot 66 in parallel-fed broadband dipole antenna 40 of FIG. 8 need not be equal to a quarter-wavelength in length at all operating frequencies. For example, a quarter of a wavelength at a given operating frequency might be 3 inches, while length LG might be only 2.5 inches or less, only 2 inches or less, or only 1.5 inches or less.

Figure 11:
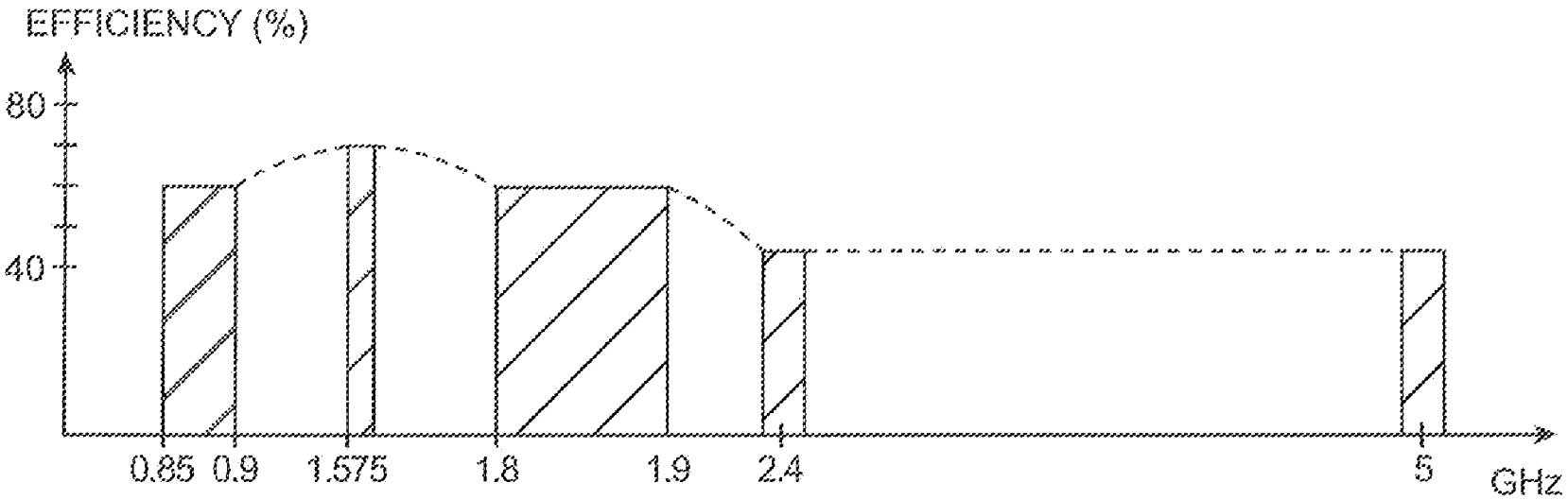
FIG. 11 is a graph of antenna efficiency plotted as a function of operating frequency for an illustrative broadband antenna in accordance with an embodiment of the present invention.

Antennas such as parallel-fed broadband dipole antenna 40 of FIG. 8 may exhibit bandwidths that are sufficiently large to cover multiple communications bands of interest. A graph showing the efficiency of an antenna such as antenna 40 of FIG. 8 as a function of operating frequency is shown in FIG. 11. As shown in FIG. 11, antennas of this type (e.g., an antenna with a slot length of 2 inches or less implemented in housing 12) may exhibit satisfactory efficiency in cellular communications bands at 850 MHz, 900 MHz, 1800 MHz, 1900 MHz, and 2100 MHz, while simultaneously exhibiting satisfactory efficiency in the GPS band at 1575 MHz and the wireless bands at 2.4 GHz (Bluetooth® and WiFi®) and 5.0 GHz (WiFi®).

Figure 12:
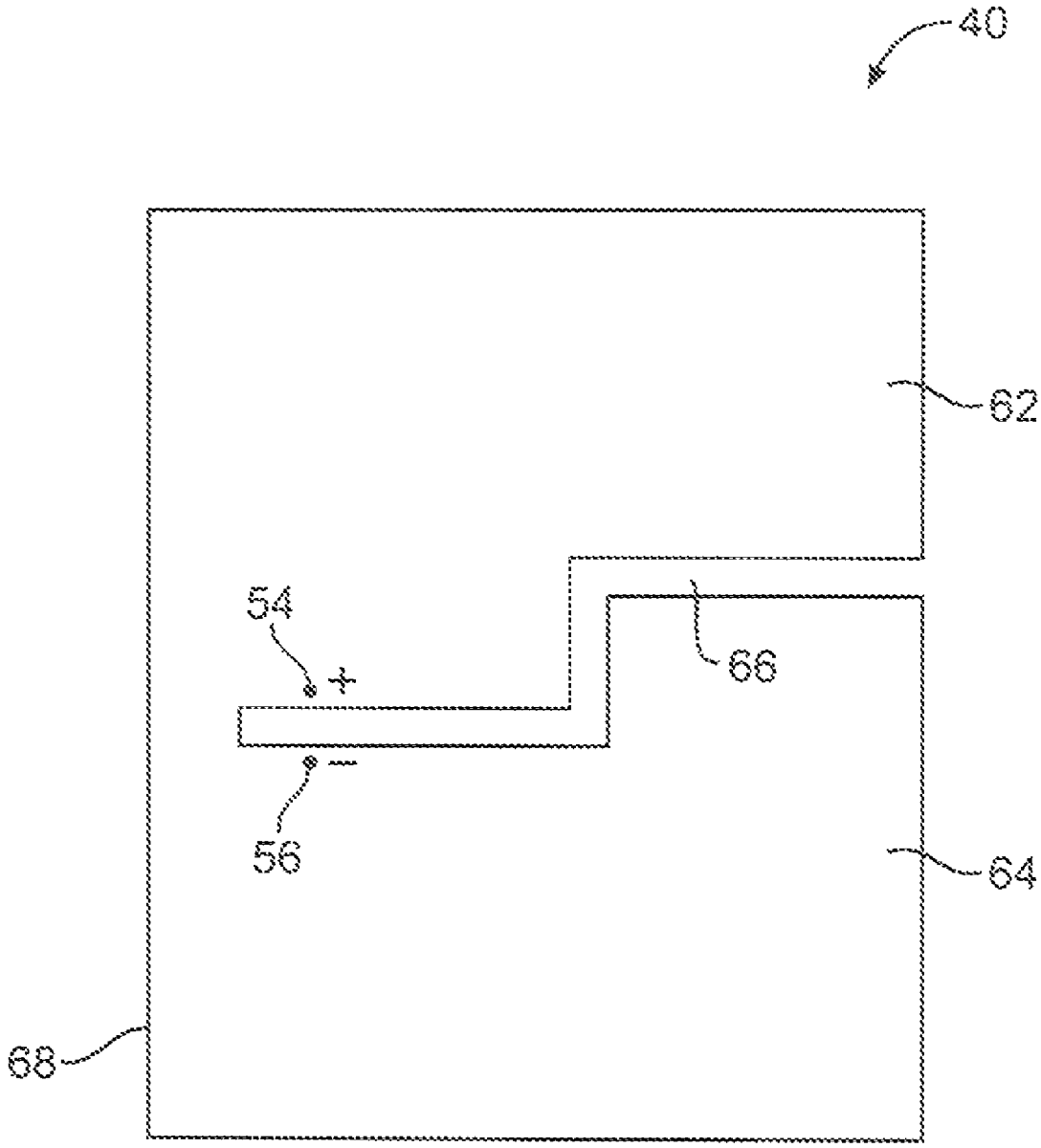
FIG. 12 is a top view of an illustrative broadband antenna with a slot opening having bends in accordance with an embodiment of the present invention.

As shown in FIG. 12, slot 66 need not be straight, but may have one or more bends. Slots with curved sections may also be used in antenna 40.

Figure 13:
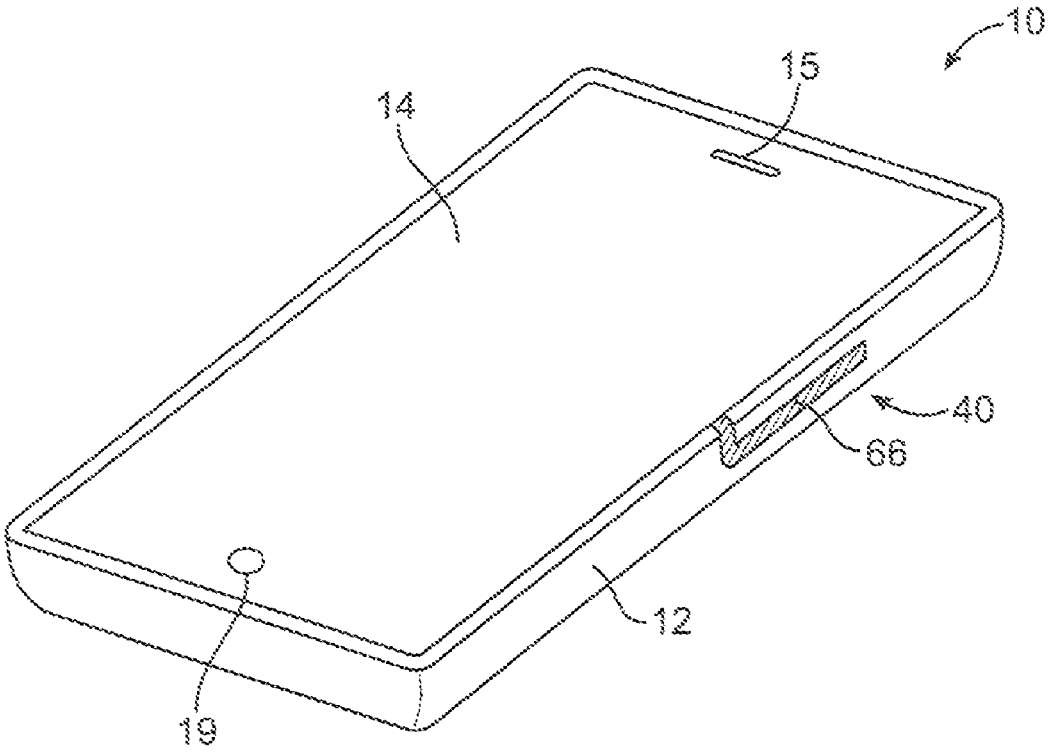
FIG. 13 is a perspective view of an electronic device having an antenna formed from a conductive housing structure in accordance with an embodiment of the present invention.

Slot 66 may be located in any suitable portion of housing 12. For example, slot 66 may be formed in the rear surface of hosing 12, in a sidewall of housing 12, on portions of both a sidewall and a rear planar section of housing 12, etc. FIG. 13 shows an illustrative example in which slot 66 of antenna 40 has been formed from a slot that runs along one of the sidewalls of housing 12. The illustrative slot of FIG. 13 has one bend. If desired, slot 66 may have no bends or may have more than one bend.

Figure 14:
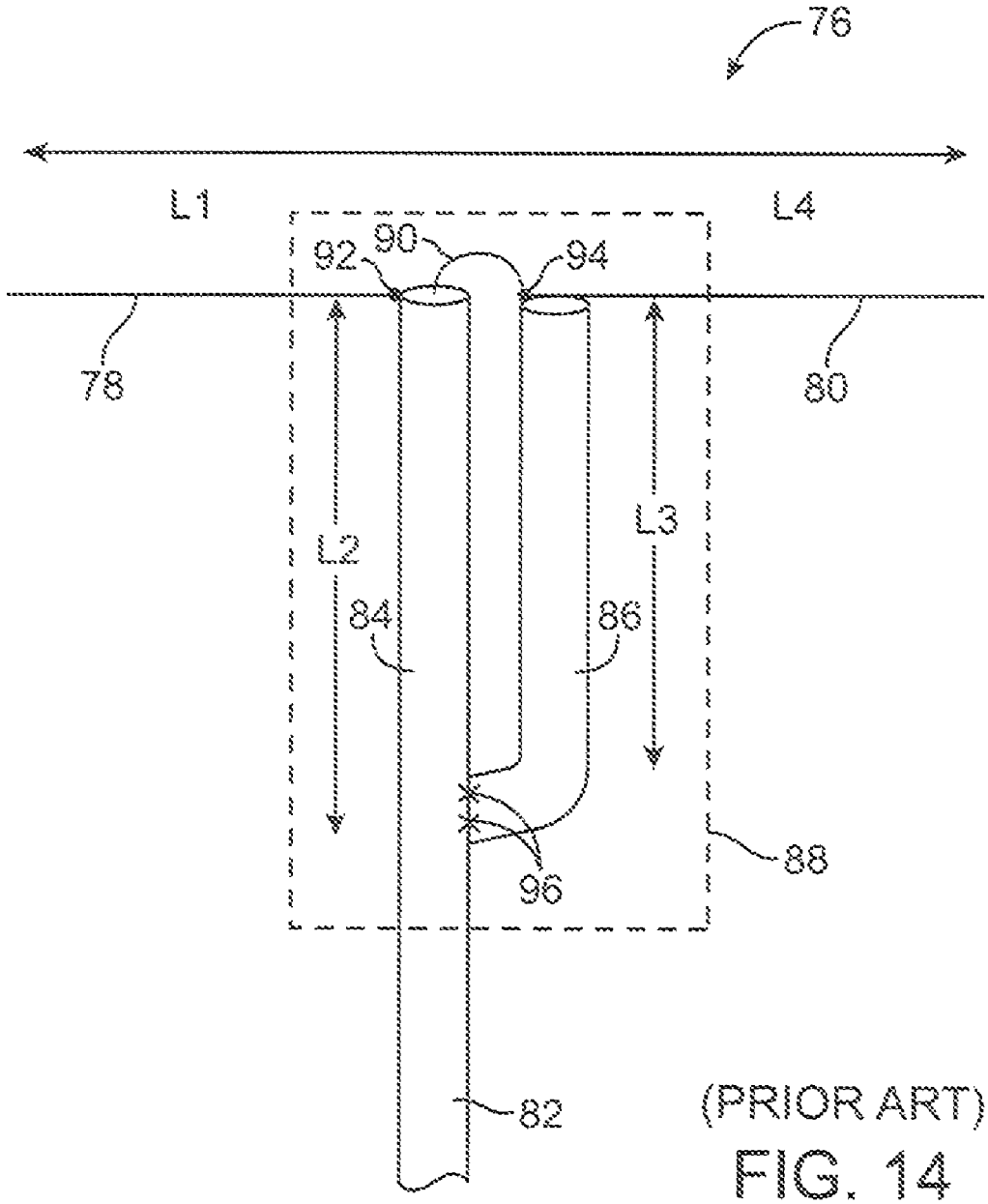
(PRIOR ART) FIG. 14
FIG. 14 is a diagram of a conventional balanced feed arrangement for a dipole antenna.

A balanced feed arrangement may be used to feed antenna 40. FIG. 14 shows a conventional balanced feed for dipole antenna 76. Dipole antenna 76 is coupled to coaxial cable 82. Coaxial cable 82 has an outer braid conductor and a center conductor. To couple coaxial cable 82 to dipole antenna 76, balun 88 is formed from coaxial cable sections 84 and 86. In coaxial cable section 84, both the outer braid conductor and the center conductor of the cable are present. The outer braid conductor is shorted to antenna arm 78 at point 92. Arm lengths L1 and L4 may be equal. Section 90 of the center conductor is connected to arm 80 at point 94. In coaxial cable section 84, only the outer braid conductor is present. This conductor is shorted to the outer braid conductor of section 84 at points 96. The size and shape of section 86 is the same as the size and shape of the outer braid conductor of section 84. Lengths L2 and L3 are also equal. In this arrangement, sections 86 and 84 exhibit equalized current densities and serve as a transmission line that feeds antenna 76.

Figure 15:
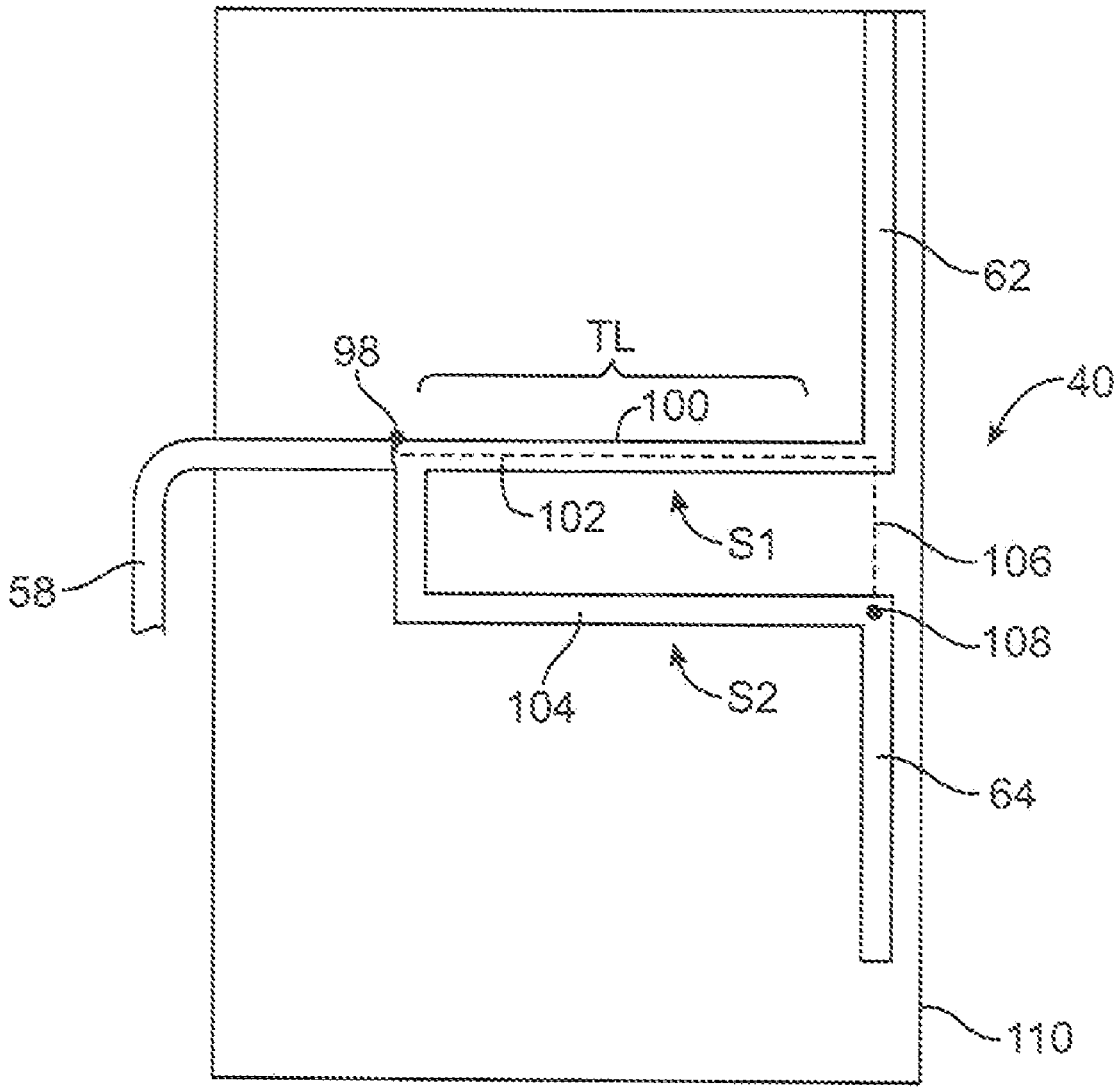
FIG. 15 is a diagram of a balanced feed arrangement that may be used in feeding an antenna in accordance with an embodiment of the present invention.

An illustrative feed arrangement that may be used for antenna 40 is shown in FIG. 15. In the example of FIG. 15, coaxial cable 58 is coupled to antenna 40 using a transmission line structure TL. Antenna 40 has a dipole-type antenna resonating element formed from first arm 62 and second arm 64. First arm 62 and second arm 64 may be formed from conductive structures on carrier 110 (e.g., a dielectric substrate such as a plastic member, rigid printed circuit board, flexible printed circuit board, etc.) or as parts of housing structures, etc.

Transmission line section TL has first and second parallel segments S1 and S2. Segment S1 has conductor 100 and conductor 102. Conductor 100 may be formed from a trace of metal on the upper surface of carrier 110. Conductor 100 may be shorted to the outer braid conductor of coaxial cable 58 at point 98 and may be formed as an integral portion of arm 62. Conductor 102 may be formed on the backside of carrier 110 to form a transmission line segment. One end of conductor 102 may be connected to the center conductor of coaxial cable 58. The other end of conductor 102 may be connected to conductive segment 106. Segment 106, which may also be formed on the backside of carrier 110, may be shorted to arm 64 through via 108.

The feed arrangement of FIG. 15 help match coaxial cable 58 to dipole antenna 40, thereby reducing signal losses and ensuring satisfactory antenna performance.

Figure 16:
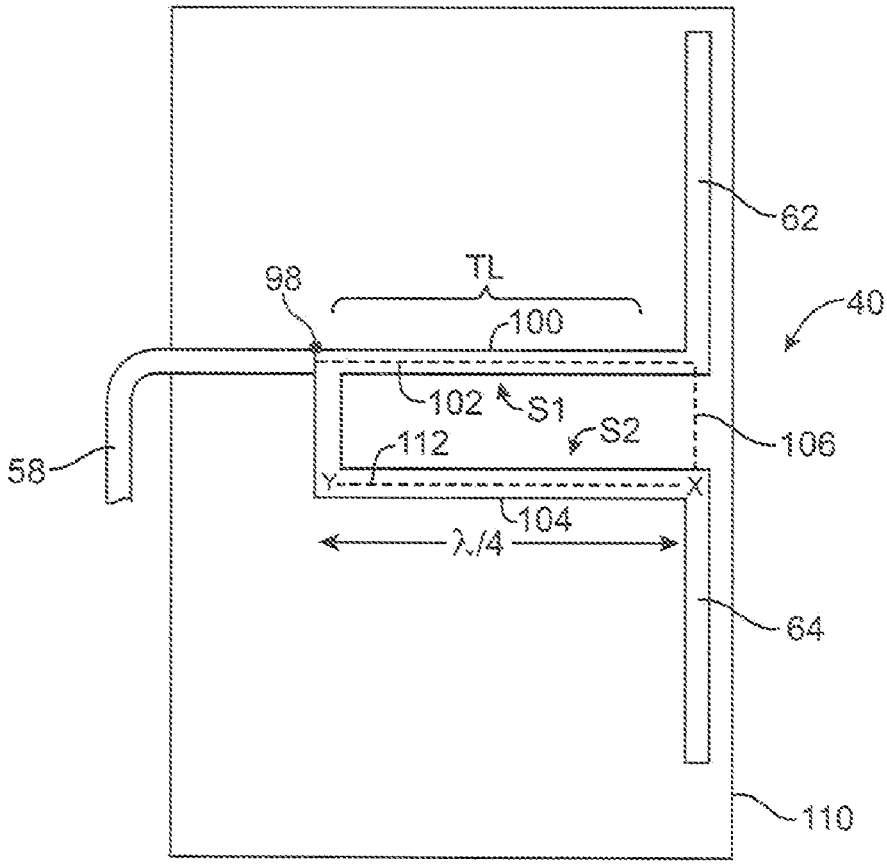
FIG. 16 is a diagram of a balanced feed arrangement that may be used in feeding an antenna in accordance with an embodiment of the present invention.
Figure 17:
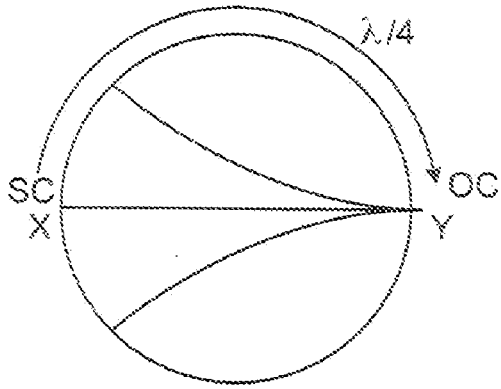
FIG. 17 is a Smith chart demonstrating how short circuit and open circuit points on an antenna element are separated by a quarter wavelength in antenna feed arrangements of the type shown in FIG. 16 in accordance with an embodiment of the present invention.

If desired, the short circuit connection provided by via 108 of FIG. 15 may be implemented at radio-frequencies without using a via (i.e., without forming an actual direct-current electrical connection between the front and back sides of carrier 110). For example, antenna 40 may be fed using an arrangement of the type shown in FIG. 16. In the arrangement of FIG. 16, segment S2 has an underlying (backside) conductor 112 that extends from point X (where via 108 of FIG. 15 was formed) to point Y, parallel to upper conductive trace 104. The length of segment S2 is about a quarter of a wavelength at operating frequencies of interest. At point Y, conductor 112 forms an open circuit (i.e., conductor 112 is not electrically connected to trace 104). As shown in the Smith chart of FIG. 17, a quarter of a wavelength away (i.e., at point X of FIG. 16), conductor 112 is electrically "shorted" at RF frequencies to conductors 104 even though an actual conductive connection has not been formed. The feed arrangement of FIG. 16 may therefore operate in substantially the same way as the feed arrangement of FIG. 15 without involving the use of a physical via such as via 108 of FIG. 15.

Figure 18:
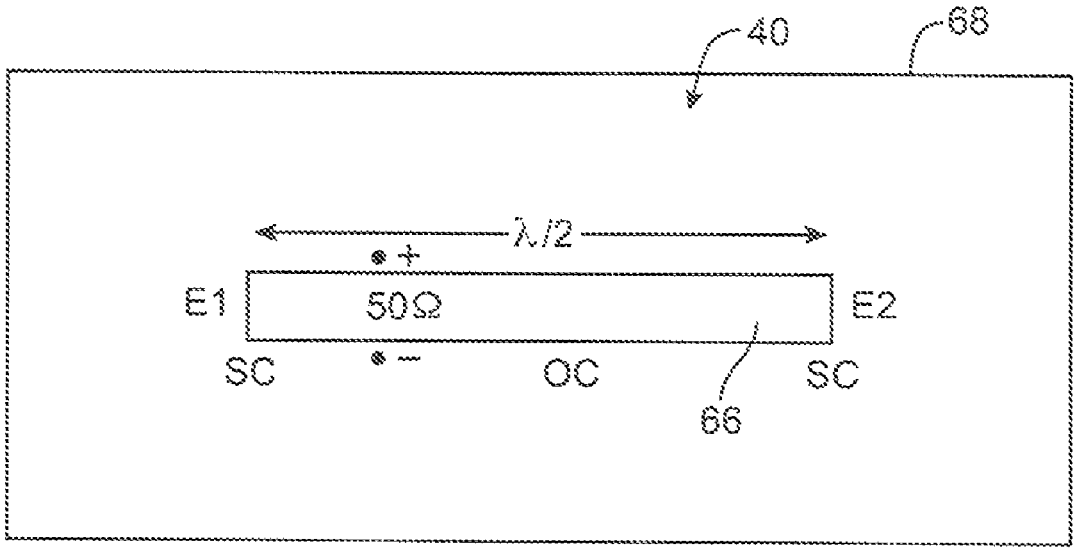
FIG. 18 is a top view of an illustrative antenna that may use a feed arrangement in accordance with an embodiment of the present invention.

As shown in FIG. 18, antenna 40 may be implemented using a closed slot in conductive structure 68. At operating frequencies of interest, the perimeter of slot 66 should be equal to one wavelength (i.e., the length of slot 66 should be about one half of a wavelength). At the ends of slot 66 (i.e., ends E1 and E2), a short circuit condition exists, as denoted by the label "SC" in FIG. 18. In the middle of slot 66, an open circuit condition exists ("OC"). At an intermediate position between the middle of slot 66 and the end of slot 66 (i.e., partway between the middle of slot 66 and end E1), antenna 40 will exhibit an intermediate impedance (e.g., 50 ohms) that is matched to the impedance of transmission line 58 (FIG. 3).

Figure 19:
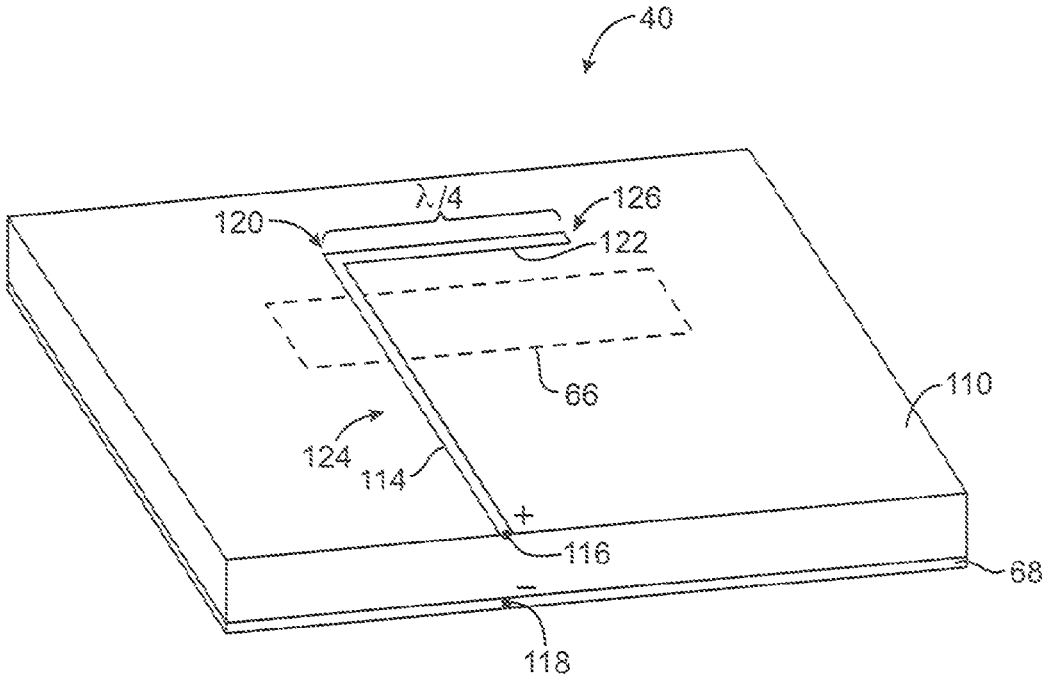
FIG. 19 is a perspective view of an illustrative antenna feed being used in conjunction with a slot antenna of the type shown in FIG. 18 in accordance with an embodiment of the present invention.

FIG. 19 shows how an antenna such as antenna 40 of FIG. 18 may be fed. Antenna 40 may have a conductive structure 68 in which slot 66 is formed. Structure 68 may be, for example, a backside metal layer on a printed circuit board or other substrate 110. Feed line 124 may be formed on the front side of substrate 110 and may form a transmission line in conjunction with backside metal layer 68 (in the regions where backside metal 68 is present under line 124). Feed line 124 may include feed line segment 114 and feed line segment 122. Coaxial cable 58 (FIG. 3) may have its positive and ground conductors connected to terminals 116 and 118, respectively. The length of segment 122 (i.e., the distance between end 126 and point 120) may be about a quarter of a wavelength at operating frequencies of interest. This forms an RF short from line 124 to backside conductive layer 68 at point 120, as described in connection with FIGS. 16 and 17. If desired, a via may be formed a point 120 to connect feed line 124 to backside conductor 68. Point 120 may form the positive feed for antenna slot 66 (e.g., feed terminal 54). The ground feed (feed 56) may be formed on the opposing side of slot 66 by the portion of metal 68 under segment 124.

It may be desirable to reduce the length of feed line 124. For example, it may be desirable to reduce the length of feed line segment 122 of FIG. 19. This may be accomplished by providing segment 122 with multiple impedances.

Figure 20:
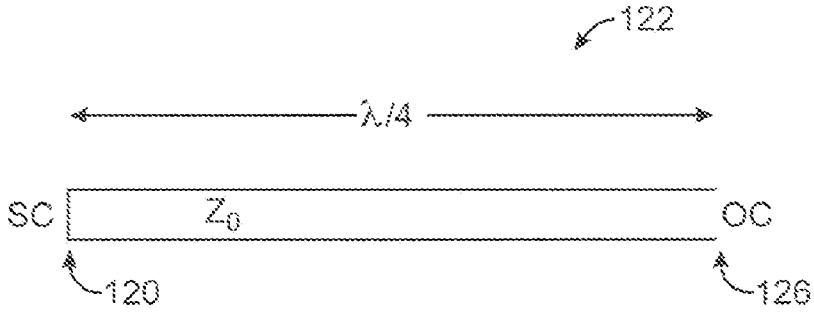
FIG. 20 is a diagram of a transmission line structure with a single impedance that may form part of an antenna feed for an antenna in accordance with an embodiment of the present invention.

FIG. 20 is a model of a feed line segment 122 having a single impedance per unit length (Zo) of the type shown in FIG. 19. At point 120, segment 122 forms a short circuit. At point 126, segment forms an open circuit.

Figure 21:
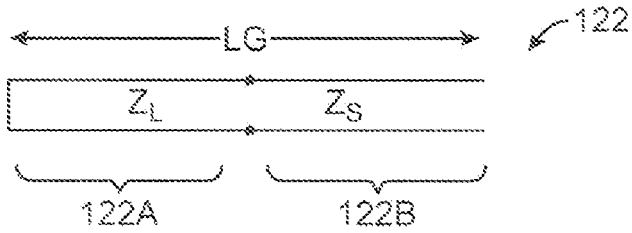
FIG. 21 is a diagram of a transmission line structure with multiple impedances that may form part of an antenna feed for an antenna in accordance with an embodiment of the present invention.

FIG. 21 shows how segment 122 may be provided with two sub-segments 122A and 122B, each with a respective impedance (large impedance Zl and small impedance Zs, respectively). By configuring the lengths of sub-segments 122A and 122B, the impedance of segment 122 of FIG. 21 can match the impedance of segment 122 of FIG. 20, but with a reduced total length (i.e., with LG of segment 122 of FIG. 21 being less than the length of segment 122 of FIG. 20).

Figure 22:
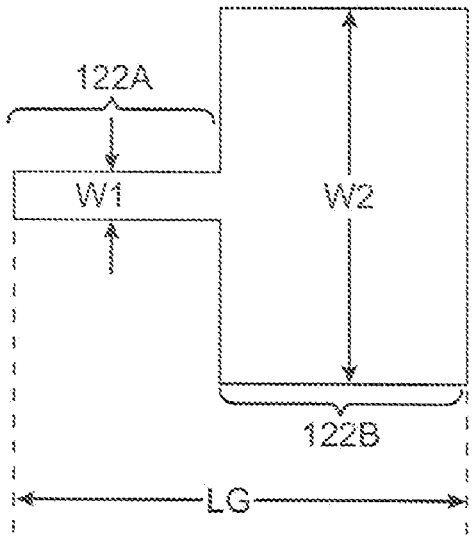
FIG. 22 is a diagram of an antenna feed line with multiple widths that may be used as part of a transmission line structure when implementing an antenna feed in an antenna in accordance with an embodiment of the present invention.

FIG. 22 shows how feed line segment 122 of FIG. 21 may be implemented using a metal trace of varying width (measured perpendicular to the longitudinal axis of feed line segment 122). The width W1 of segment 122A is less than the width W2 of segment 122B, creating desired impedances Zl and Zs, respectively. In this example, the impedances of segments 122A and 122B were adjusted using a feed line conductor in which different segments of the conductor were provided with different widths. This is merely one illustrative way in which to adjust the impedances of antenna feed line segments 122A and 122B. In general, a microstrip transmission line such as segment 122 has an impedance that is proportional to width, the dielectric constant of substrate 110 (FIG. 19), and the thickness T of substrate 110. If desired, a multi-impedance structure of the type shown in FIG. 21 can be implemented by changing any one or more of these parameters (e.g., by forming segment 122 from structures with underlying substrate materials with different dielectric constants, by varying the thickness of the substrate under different portions of segment 122, by changing the width of conductor 122, or by using combinations of these approaches).

Figure 23:
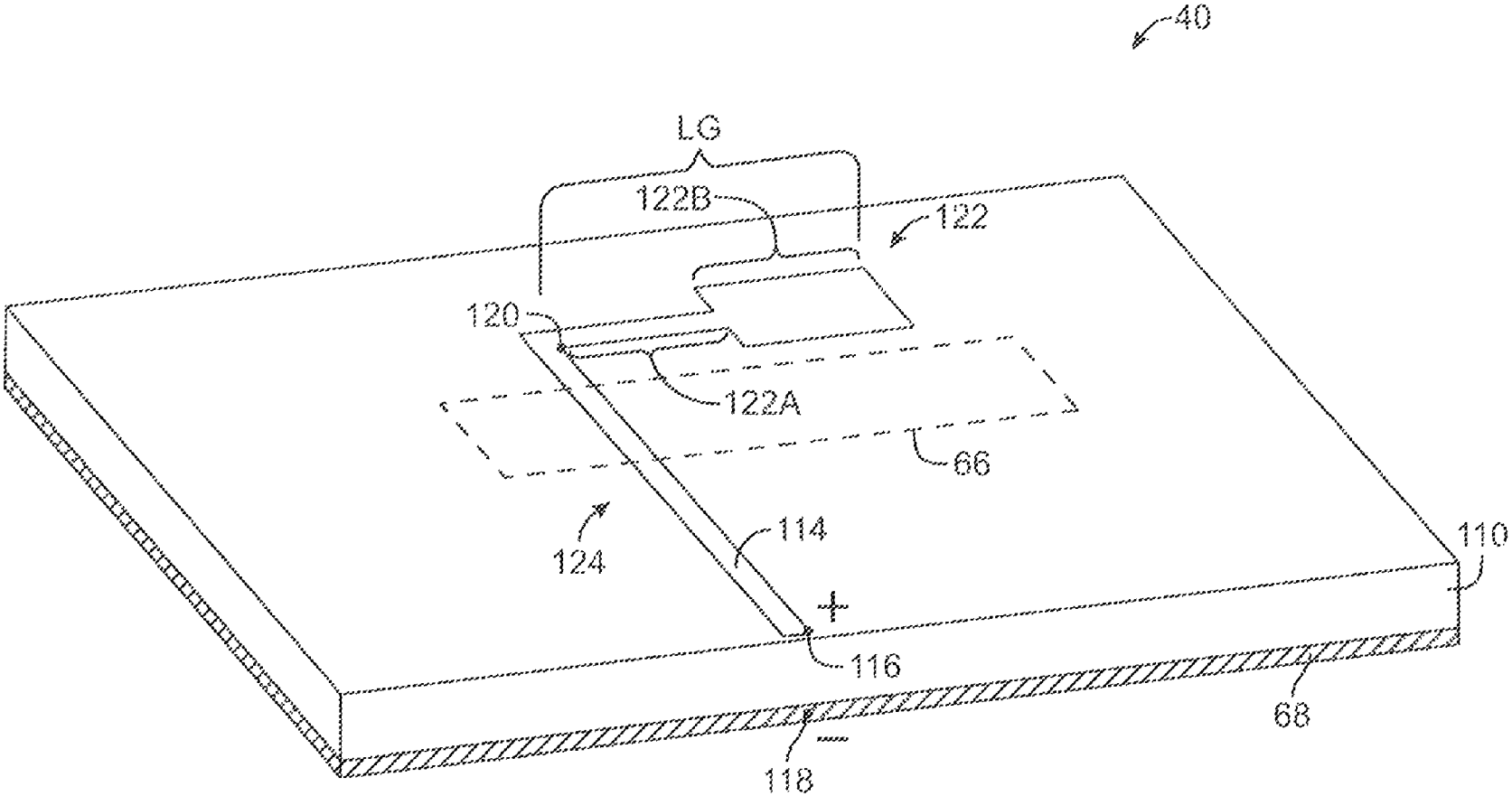
FIG. 23 is a perspective view of an illustrative antenna feed configuration that has unequal feed conductor widths and is being used in conjunction with a slot antenna of the type shown in FIG. 18 in accordance with an embodiment of the present invention.

FIG. 23 shows how an antenna of the type shown in FIG. 19 may be implemented using a transmission line feed segment such as segment 122 of FIG. 22. As shown in FIG. 23, segment 122 may include sub-segments 122A and 122B of differing impedances. Using this approach, the length LG of segment 122 may be shorter than the quarter wavelength length of segment 122 of FIG. 19. If desired, feed path 124 may be formed without the bend at point 120. For example, feed path 124 may be formed from a line in which segment 122 runs parallel to segment 114, or in which path 124 has one or more, two or more, or three or more bends, curves, etc.

Figure 24:
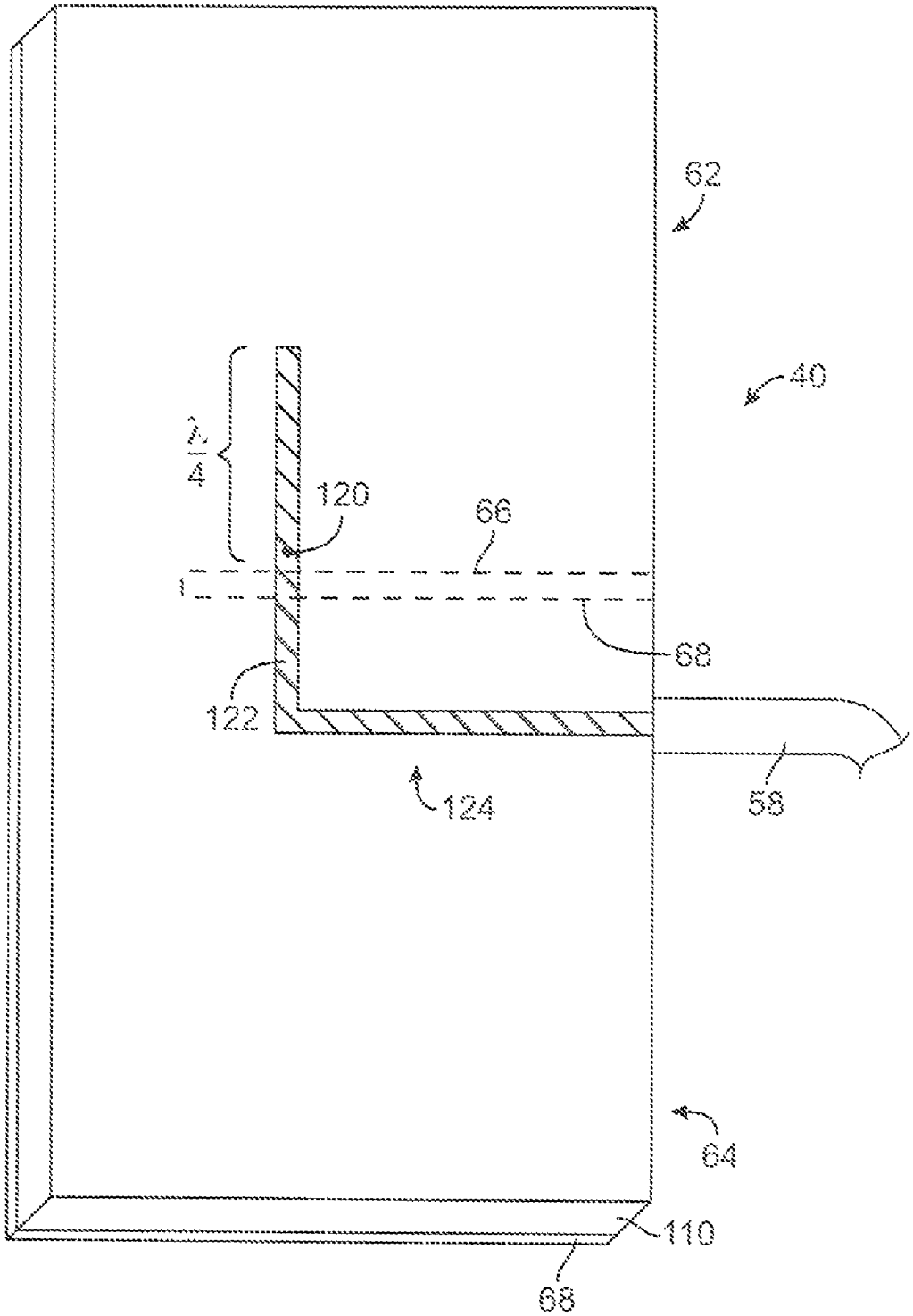
FIG. 24 is a top view of an illustrative antenna in which a feed conductor traverses an open slot in a ground plane in accordance with an embodiment of the present invention.
Figure 25:
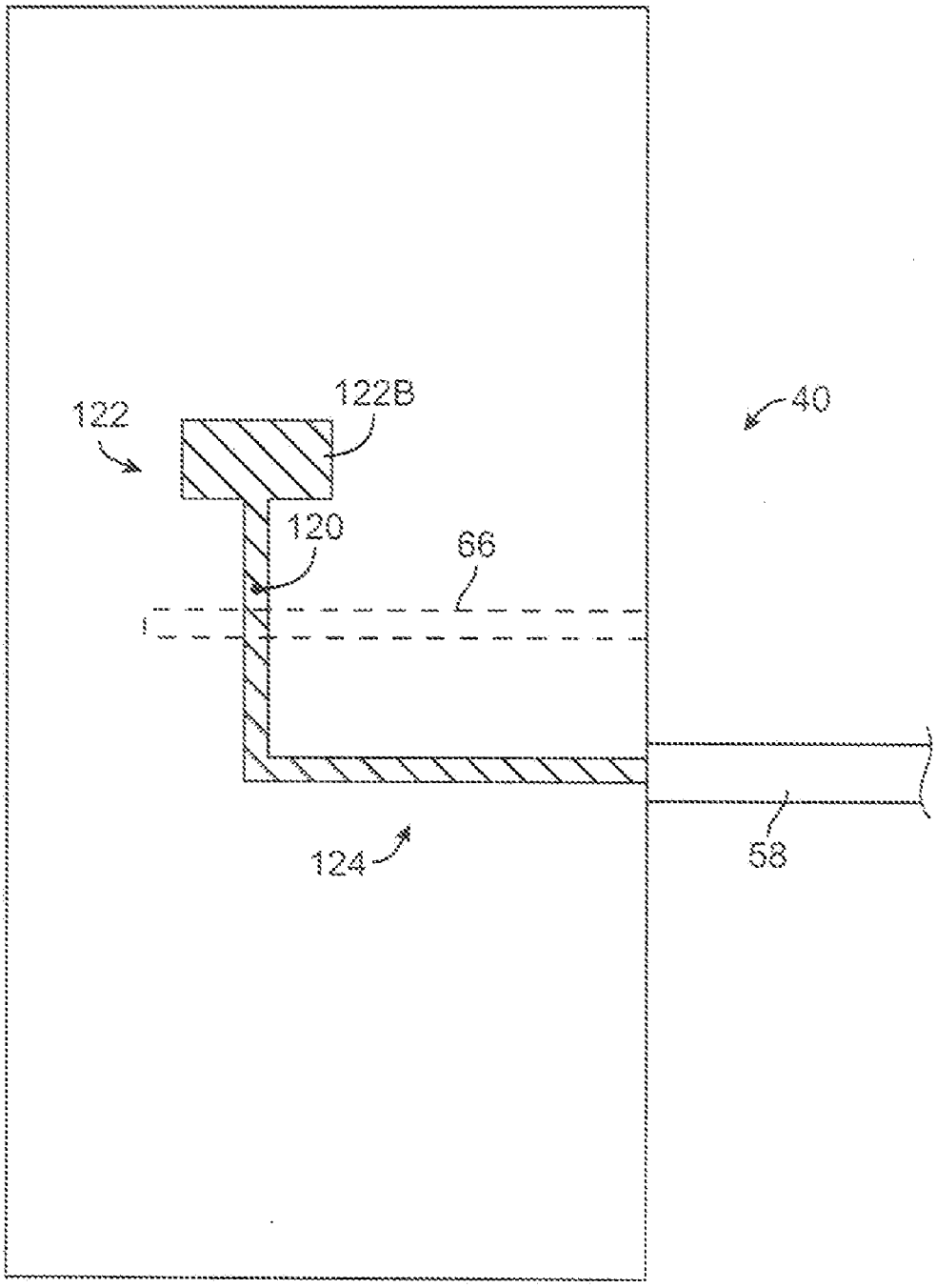
FIG. 25 is a top view of an illustrative antenna of the type shown in FIG. 21 that has a feed conductor with unequal widths along its length in accordance with an embodiment of the present invention.

Feed arrangements such as these may be used with equal current density dipoles such as broadband dipole antenna 40 of FIG. 8 or other antennas. FIG. 24 is a top view of an illustrative feed arrangement of the type shown in FIG. 19 being used to feed a broadband dipole antenna of the type shown in FIG. 8. As shown in FIG. 24, segment 122 may have a length of about a quarter of a wavelength at an operating frequency of interest to ensure that segment 122 of front-side trace 1224 is "shorted" at radio frequencies to backside conductor 68. FIG. 25 shows how segment 122 may be provided with widened portion 122B to reduce its overall length, as described in connection with FIG. 22.

Figure 26:
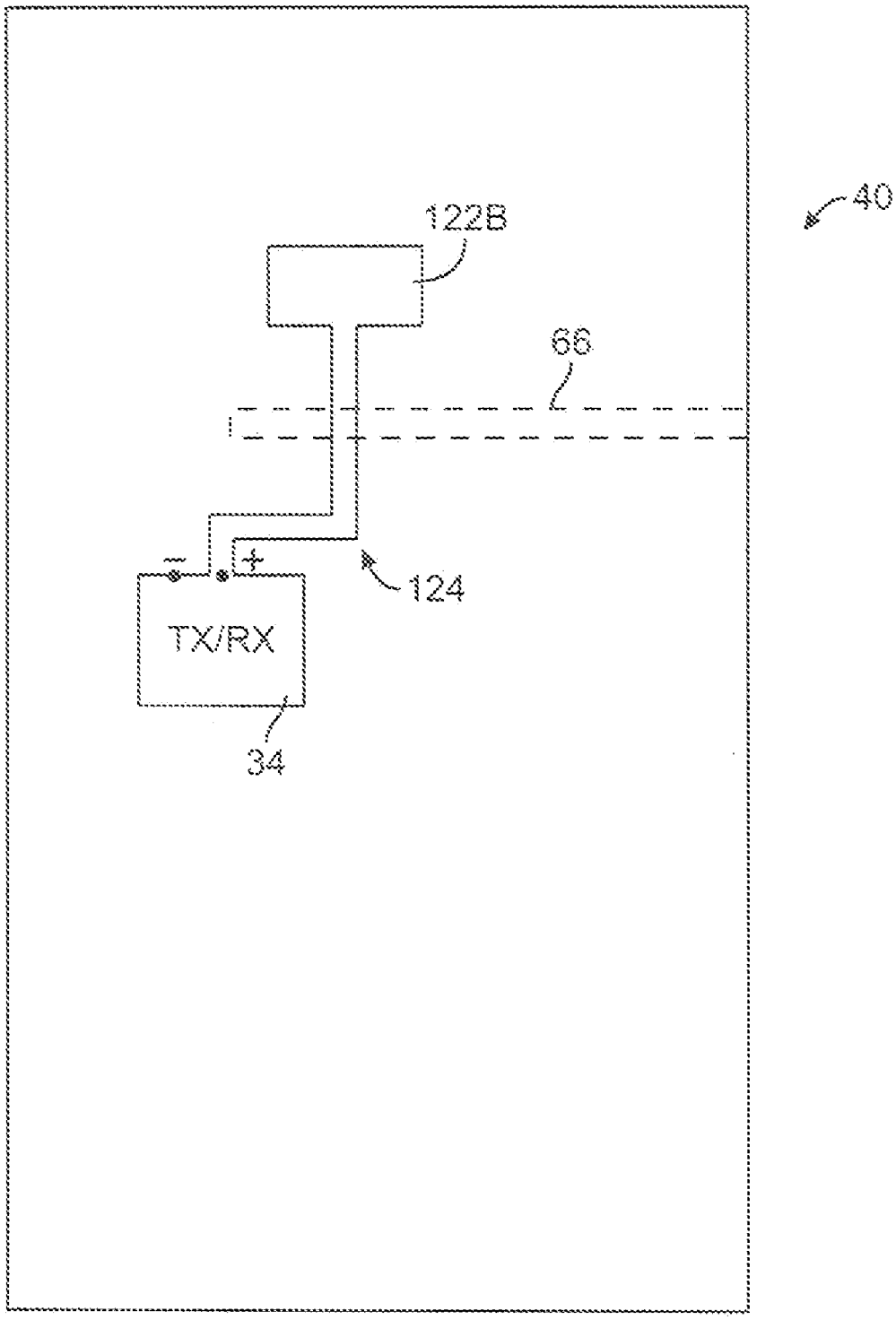
FIG. 26 is a top view of an illustrative antenna having a feed of the type shown in FIG. 22 that is coupled to a radio-frequency transceiver circuit in accordance with an embodiment of the present invention.

In the illustrative arrangement of FIG. 26, transceiver circuitry 34 (e.g., cellular transceiver circuitry 38 of FIG. 2, local area network circuitry 36 of FIG. 2, and satellite positioning system receiver circuitry 39 of FIG. 2) may be coupled to transmission line 124 to feed antenna 40.

Figure 27:
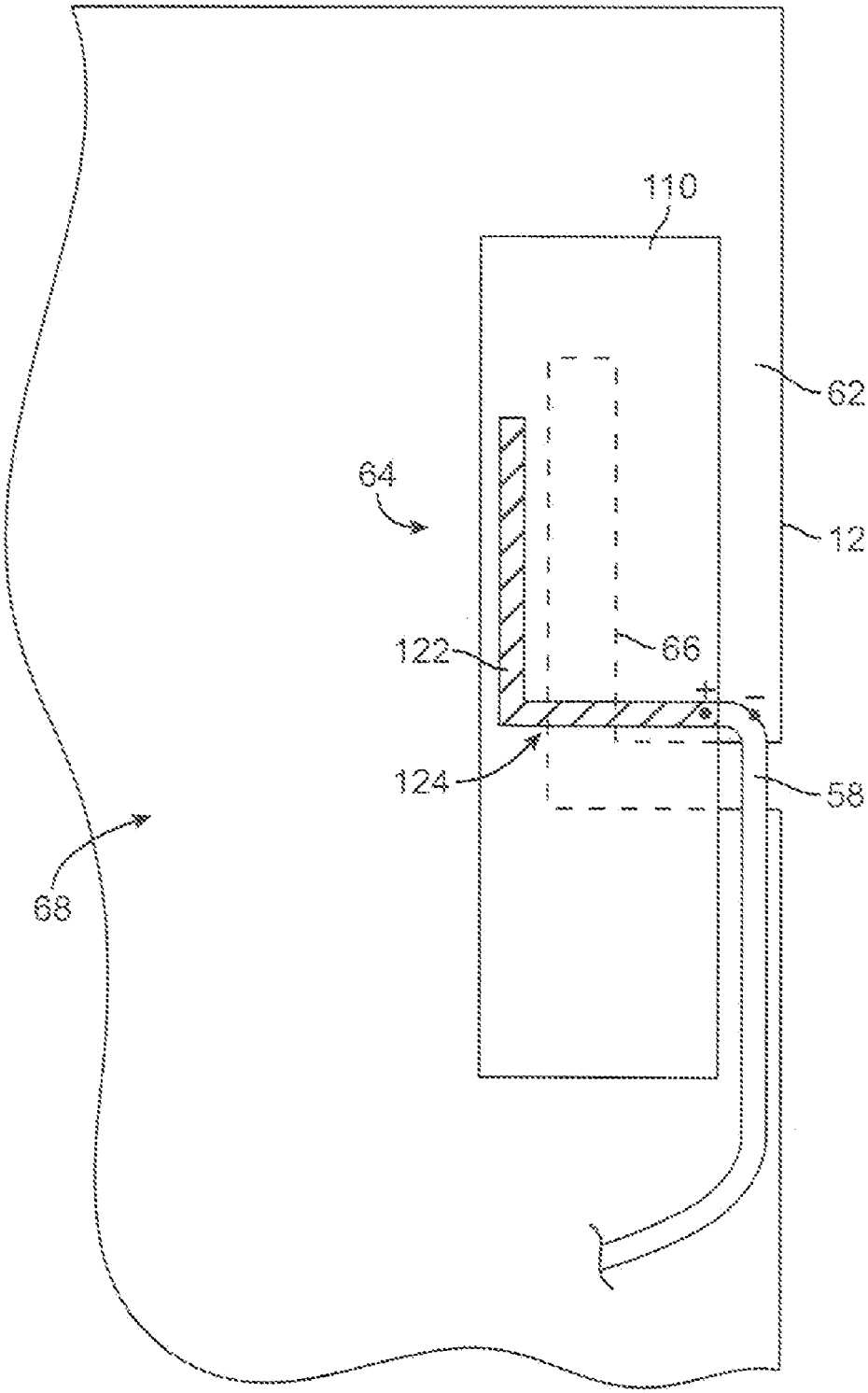
FIG. 27 is an interior view of a portion of an electronic device showing how a conductive housing may be provided with an antenna in accordance with an embodiment of the present invention.

As shown in FIG. 27, conductive structure 68 may be formed from housing 12. Conductive structures 68 may, for example, be formed from housing sidewalls, a rear planar housing wall, parts of sidewalls and part of a rear wall, or other suitable conductive housing structures. Slot 66 may be formed in housing 12 (e.g., in metal housing walls). A portion of slot 66 may run parallel to the edges of display 14 and housing 12. If desired, slot 66 may have a bend and may be formed in housing 12 so that slot 66 appears as shown in FIG. 13. Feed trace 124 and segment 122 may be located on substrate 110 (e.g., a rigid or flexible printed circuit board). The positive and ground conductors of coaxial cable 58 may be coupled to front-side trace 124 and conductive structure 68, respectively. As with the illustrative feed arrangements of FIG. 23, antenna feed line 124 runs perpendicular to slot 66 as feed line 124 crosses slot 66 and bends to form section 122. If desired, section 122 may be provided with a widened segment such as segment 122B of FIG. 23.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device, comprising:

a housing having at least some conductive housing structures;

an open slot formed in the conductive structures, wherein the open slot has a closed end and an open end; and an antenna formed from a first portion of the conductive housing structures located on one side of the slot and a second portion of the conductive housing structures located on an opposing side of the slot; and an antenna feed for the antenna that has an antenna feed line that crosses the slot and that is not connected to the conductive housing structures.

2. The electronic device defined in claim 1 further comprising a transmission line having a first signal conductor that is coupled to the antenna feed line and a second signal conductor that is connected to the housing structure.

3. The electronic device defined in claim 2 further comprising a dielectric substrate, wherein the antenna feed line comprises a conductive trace on the substrate.

4. The electronic device defined in claim 3 wherein the electronic device comprises a housing having four edges and wherein the slot has at least one portion that runs parallel to at one of the edges.

5. The electronic device defined in claim 1 further comprising a coaxial cable, wherein the coaxial cable has a center conductor coupled to the antenna feed line.

6. The electronic device defined in claim 1 wherein the antenna feed line has portions of different widths.

7. The electronic device defined in claim 1, wherein the antenna comprises a broadband antenna, the electronic device further comprising:

wireless circuitry that operates in communications bands at 850 MHz, 900 MHz, 1575 MHz, 1800 MHz, 1900 MHz, 2.4 GHz, and 5.0 GHz; and a transmission line path that couples the wireless circuitry to the antenna feed, wherein the wireless circuitry receives signals in all of the communications bands at 850 MHz, 900 MHz, 1575 MHz, 1800 MHz, 1900 MHz, 2.4 GHz, and 5.0 GHz using the broadband antenna.

8. The electronic device defined in claim 7 wherein the electronic device comprises a cellular telephone, wherein the electronic device comprises a display having edges, and wherein at least some of the slot runs parallel to one of the edges of the display.

9. The electronic device defined in claim 8 wherein the antenna feed line has a plurality of different widths.

10. The electronic device defined in claim 9 wherein the slot has a length of less than two inches.

11. The electronic device defined in claim 1 wherein the slot has a length of less than two inches.

12. An antenna, comprising:

conductive structures having a slot, wherein the conductive structures are formed from conductive housing structures;

a dielectric member that covers at least part of the slot; and an antenna feed having an antenna feed line on the dielectric member that crosses the slot, wherein the dielectric member is interposed between the antenna feed line and the conductive structures so that the antenna feed line is not connected to the conductive structures.

13. The antenna defined in claim 12 wherein the slot comprises an open slot that has a closed end and an open end.

14. The antenna defined in claim 13, wherein the dielectric member comprises a layer of printed circuit board material.

15. The antenna defined in claim 14 wherein the conductive structures comprise metal electronic device housing structures.

16. The antenna defined in claim 14 wherein the conductive structures include at least some conductive electronic device housing sidewalls.

17. An electronic device, comprising:

a display;

a conductive housing in which the display is mounted, wherein the conductive housing has conductive housing wall structures;

a slot formed in the conductive housing wall structures;

an antenna formed from a first portion of the conductive housing wall structures located on one side of the slot and a second portion of the conductive housing wall structures located on an opposing side of the slot; and an antenna feed for the antenna that has an antenna feed line that crosses the slot; and a dielectric substrate, wherein the antenna feed line is separated from the conductive housing wall structures by the dielectric substrate and is not connected to the conductive housing structures.

18. The electronic device defined in claim 17 wherein the slot comprises an open slot that has a closed end and an open end.

19. The electronic device defined in claim 18 wherein the antenna feed line has a first segment that has a first width and has a second segment that has a second width that is larger than the first width, wherein the first and second segments are both located on the opposing side of the slot.

* * * * *